US012439955B2

(12) United States Patent
Moloney et al.

(10) Patent No.: US 12,439,955 B2
(45) Date of Patent: Oct. 14, 2025

(54) ARTICLE FOR USE WITH APPARATUS FOR HEATING AEROSOLIZABLE MATERIAL

(71) Applicant: NICOVENTURES TRADING LIMITED, London (GB)

(72) Inventors: Patrick Moloney, London (GB); Glen Elgar, London (GB); John Major, London (GB); Dorcas Chan, London (GB); Anton Korus, London (GB)

(73) Assignee: NICOVENTURES TRADING LIMITED, London (GB)

( * ) Notice: Subject to any disclaimer, the term of this patent is extended or adjusted under 35 U.S.C. 154(b) by 920 days.

(21) Appl. No.: 17/250,999

(22) PCT Filed: Oct. 14, 2019

(86) PCT No.: PCT/EP2019/077788
§ 371 (c)(1),
(2) Date: Apr. 9, 2021

(87) PCT Pub. No.: WO2020/074744
PCT Pub. Date: Apr. 16, 2020

(65) Prior Publication Data

US 2021/0329965 A1 Oct. 28, 2021

(30) Foreign Application Priority Data

Oct. 12, 2018 (GB) ..... 1816649

(51) Int. Cl.

| | |
|---|---|
| ***A24D 1/20*** | (2020.01) |
| ***A24B 15/12*** | (2006.01) |
| ***A24B 15/167*** | (2020.01) |
| ***A24C 5/01*** | (2020.01) |
| ***A24D 1/02*** | (2006.01) |
| ***A24F 40/20*** | (2020.01) |
| ***A24F 40/465*** | (2020.01) |

(52) U.S. Cl.
CPC ..... *A24D 1/20* (2020.01); *A24B 15/12* (2013.01); *A24B 15/167* (2016.11); *A24C 5/01* (2020.01); *A24D 1/02* (2013.01); *A24F 40/20* (2020.01); *A24F 40/465* (2020.01)

(58) Field of Classification Search
CPC ..... A24B 15/12; A24B 15/167; A24C 5/01; A24D 1/02; A24D 1/20; A24F 40/20; A24F 40/465
See application file for complete search history.

(56) References Cited

U.S. PATENT DOCUMENTS

| | | | | |
|---|---|---|---|---|
| 498,927 | A * | 6/1893 | Butler | A24D 1/02 131/365 |
| 599,834 | A * | 3/1898 | Eaton | A24D 1/02 131/365 |
| 2017/0055581 | A1* | 3/2017 | Wilke | A24D 1/20 |
| 2017/0055582 | A1 | 3/2017 | Blandino et al. | |

FOREIGN PATENT DOCUMENTS

| | | | |
|---|---|---|---|
| AU | 2016313701 | A1 | 3/2018 |
| EA | 000244 | B1 | 2/1999 |
| EA | 022685 | B1 | 2/2016 |
| EA | 023735 | B1 | 7/2016 |
| EP | 0917830 | A1 | 5/1999 |
| KZ | 32606 | B | 12/2017 |
| RU | 2132629 | C1 | 7/1999 |
| RU | 2657215 | C2 | 6/2018 |

* cited by examiner

*Primary Examiner* — Michael H. Wilson
*Assistant Examiner* — Adam Z Baratz
(74) *Attorney, Agent, or Firm* — WOMBLE BOND DICKINSON (US) LLP

(57) ABSTRACT

An article for use with an apparatus for heating aerosolizable material to volatilize at least one component of the aerosolizable material includes a body of aerosolizable material; and a first wrapper around the body aerosolizable material. The first wrapper comprises heater material that is heatable by penetration with a varying magnetic field. The first wrapper comprises an outer surface and an inner surface and the first wrapper is arranged so that two opposing strips of the outer surface are joined along ends of the first wrapper or the first wrapper is arranged so that two opposing strips of the inner surface are joined along ends of the first wrapper, so as to form a closed electrical circuit of the heater material. A method of and apparatus for manufacturing an article for use with an apparatus for heating aerosolizable material to volatilize at least one component of the aerosolisable material are also disclosed.

12 Claims, 8 Drawing Sheets

ARTICLE FOR USE WITH APPARATUS FOR HEATING AEROSOLIZABLE MATERIAL

PRIORITY CLAIM

The present application is a National Phase entry of PCT Application No. PCT/EP2019/077788, filed Oct. 14, 2019, which claims priority from Patent Application No. 1816649.6, filed Oct. 12, 2018, each of which is hereby fully incorporated herein by reference.

TECHNICAL FIELD

The present disclosure relates to articles for use with apparatus for heating aerosolizable material to volatilize at least one component of the aerosolizable material, to methods of manufacturing such articles, and to systems comprising such articles and apparatuses.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect of the present disclosure provides an article for use with an apparatus for heating aerosolizable material to volatilize at least one component of the aerosolizable material, the article comprising: a body of aerosolizable material; and a first wrapper around the body aerosolizable material, wherein the first wrapper comprises heater material that is heatable by penetration with a varying magnetic field, the first wrapper comprising an outer surface and an inner surface and wherein the first wrapper is arranged so that two opposing strips of the outer surface are joined along ends of the first wrapper or the first wrapper is arranged so that two opposing strips of the inner surface are joined along ends of the first wrapper, so as to form a closed electrical circuit of the heater material.

The first wrapper may comprise a layer of metallized foil which is the heater material.

The first wrapper may comprise a layer of substrate material lined with the layer of metallized foil.

The first wrapper may be folded so that two opposing strips of the inner surface contact each other at joined ends of the first wrapper and the inner surface is an inner surface of the layer of metallized foil.

The first wrapper may be folded so that two opposing strips of the outer surface contact each other at joined ends of the first wrapper and the outer surface is an outer surface of the layer of metallized foil.

The joined ends of the first wrapper may be folded about the body of aerosolizable material.

A second aspect of the present disclosure provides a method of manufacturing an article for use with an apparatus for heating aerosolizable material to volatilize at least one component of the aerosolizable material, the method comprising: providing a body of aerosolizable material; and providing a first wrapper around the body of aerosolizable material, wherein the first wrapper comprises heater material that is heatable by penetration with a varying magnetic field and the first wrapper comprises an outer surface and an inner surface; arranging the first wrapper so that two opposing strips of the outer surface contact each other along ends of the first wrapper or, arranging the first wrapper so that two opposing strips of the inner surface contact each other along ends of the first wrapper; joining the two opposing strips so as to form a closed electrical circuit of the heater material.

A third aspect of the present disclosure provides an apparatus for manufacturing an article for use with an apparatus for heating aerosolizable material to volatilize at least one component of the aerosolizable material, the apparatus configured to: provide a body of aerosolizable material; and provide a first wrapper around the body of aerosolizable material, wherein the first wrapper comprises heater material that is heatable by penetration with a varying magnetic field and the first wrapper comprises an outer surface and an inner surface; arrange the first wrapper so that two opposing strips of the outer surface contact each other along ends of the first wrapper or, arranging the first wrapper so that two opposing strips of the inner surface contact each other along ends of the first wrapper; join the two opposing strips so as to form a closed electrical circuit of the heater material In respective exemplary embodiments, the article of the system may have any of the features of the above-described exemplary embodiments of the article of the first aspect of the present disclosure.

BRIEF DESCRIPTION OF THE DRAWINGS

Embodiments of the disclosure will now be described, by way of example only, with reference to the accompanying drawings, in which.

DETAILED DESCRIPTION

Figure 1:
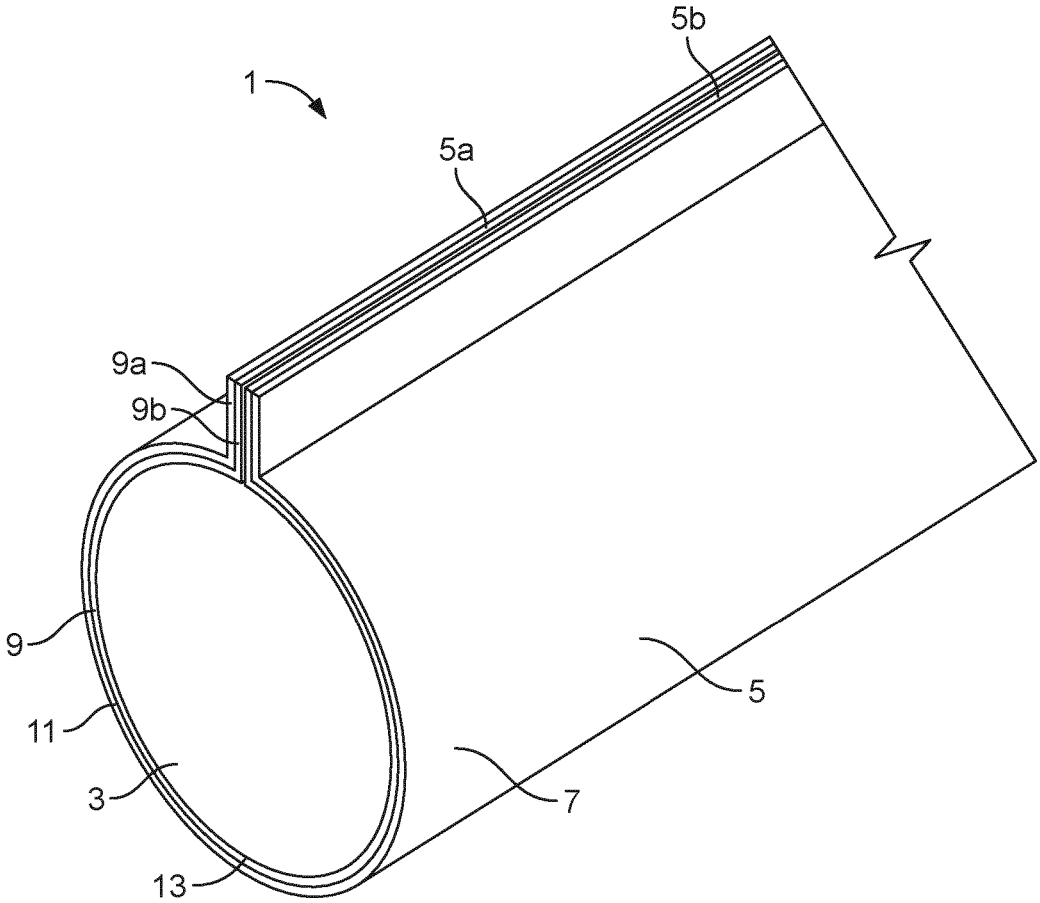
FIG. 1 shows a schematic perspective view of a section of an article for use with an apparatus for heating aerosolizable material when the article is in a partially assembled state.

As used herein, the term "aerosolizable material" includes materials that provide volatilized components upon heating, typically in the form of vapor or an aerosol. "aerosolizable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The aerosolizable material can be in the form of ground tobacco, cut rag tobacco, extruded tobacco, liquid, gel, gelled sheet, powder, or agglomerates. "aerosolizable material" also may include other, non-tobacco, products, which, depending on the product, may or may not contain nicotine. "aerosolizable material" may comprise one or more humectants, such as glycerol or propylene glycol.

As used herein, the term "heating material" refers to material that is heatable by penetration with a varying magnetic field.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, gel, powder, or the like.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed electrical circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, material deposits on the object such as smokable material residue may be less of an issue, design freedom and control over the heating profile may be greater, and cost may be lower.

Figure 2:
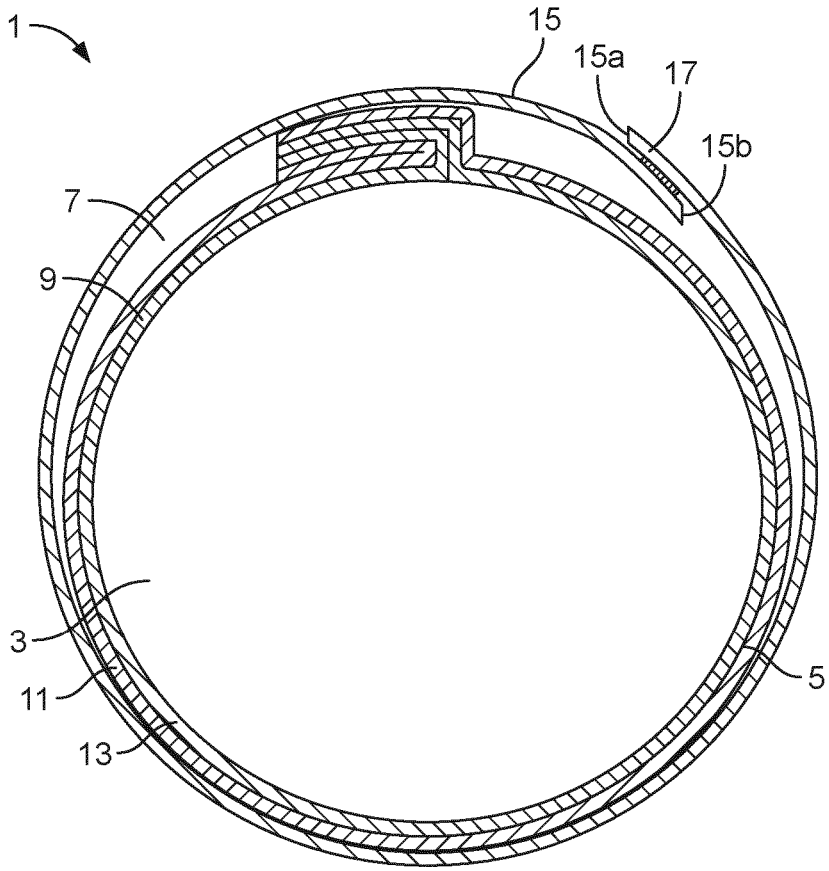
FIG. 2 shows a schematic cross-sectional view of the article when the article is in a fully assembled state.

Referring to FIGS. 1 and 2 there are shown a schematic perspective view and a schematic cross-sectional view respectively of a first example of an article 1 for use with an apparatus for heating, but not burning, aerosolizable material. FIG. 1 shows a section of the article 1 when the article 1 is in a partially assembled state and FIG. 2 shows the article 1 in a fully assembled state.

The article 1 comprises a body of aerosolizable material 3 and a first wrapper 5 around the body of aerosolizable material 3. The article 1 is for use with an apparatus for heating the aerosolizable material 3 to volatilize at least one component of the body of aerosolizable material 3 without burning the body of aerosolizable material 3. An example of such apparatus is described below.

The first wrapper 5 comprises heating material that is heatable by penetration with a varying magnetic field, as will be described in more detail below. The heating material may be heatable in use to heat the body of aerosolizable material 3. In this example, the first wrapper 5 comprises a closed electrical circuit of the heating material.

In this example, the body of aerosolizable material 3 is elongate and cylindrical with a substantially circular cross section. However, in other examples, the body of aerosolizable material 3 may have a cross section other than circular and/or not be elongate and/or not be cylindrical. The aerosolizable material 3 may for example have a diameter of around 3 mm to 8 mm although of course other diameters are possible.

In some examples, the article 1 may form part of a larger consumable article (not shown) which has proportions approximating those of a traditional combustible cigarette.

In this example, the first wrapper 5 comprises an outer surface 7 facing generally outwardly of the article 1 and an inner surface 9 facing generally inwardly of the article 1. As most clearly shown in FIG. 1, the first wrapper 5 is arranged so that two opposing strips 9*a*, 9*b* of the inner surface 9 are joined along free ends 5*a*, 5*b* of the wrapper 5 in order to form a closed electrical circuit of the heater material (as described in more detail below).

In the example of FIGS. 1 and 2, the first wrapper 5 comprises a first layer, for example a sheet, of substrate material 11, for example paper, lined with a second layer, for example a sheet, of metallized foil 13. In this example, the layer of metallized foil 13 comprises the heating material.

The first wrapper 5 may for example have a thickness that is comparable with that of tipping paper as used in traditional combustible cigarettes.

In this example, the inner surface 9 is an inner surface of the layer of metallized foil 13 and the outer surface 7 is an outer surface of the layer of substrate material 11.

Figure 3:
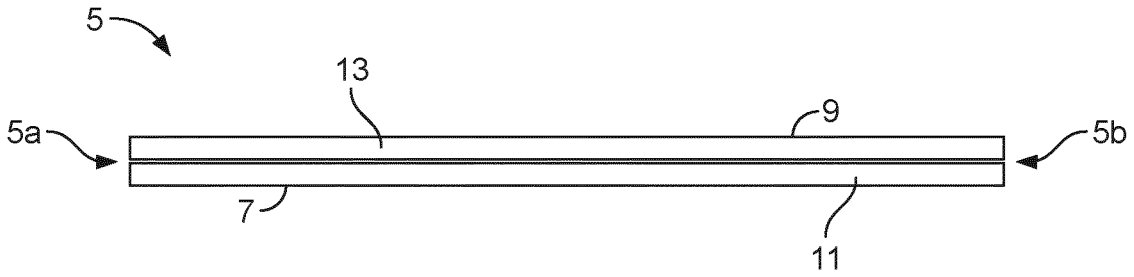
FIG. 3 shows a schematic cross-sectional view of a wrapper of the article.

As illustrated in FIG. 3, it will be appreciated that, in this example, the first wrapper 5 when in an 'un-wrapped' state is substantially rectangular with the free ends 5*a*, 5*b* running parallel with the longitudinal axis of the first wrapper 5.

In this example, the layer of metallized foil 13 comprises any suitable metallic material, for example, aluminum, which acts as the heating material. The heating material is a material that is capable of being inductively heated, and may in some instances be referred to as a susceptor.

In some examples, the heating material of the first wrapper 5 may comprise one or more materials selected from the group consisting of: an electrically-conductive material, a magnetic material, and a non-magnetic material. In some examples, the heating material may comprise a metal or a metal alloy. In some examples, the heating material may comprise one or more materials selected from the group consisting of: aluminum, gold, iron, nickel, cobalt, conductive carbon, graphite, plain-carbon steel, stainless steel, ferritic stainless steel, copper, and bronze. Other heating material(s) may be used in other examples. It has also been found that, when magnetic electrically-conductive material is used as the heating material, magnetic coupling between the magnetic electrically-conductive material and an electromagnet of the apparatus in use may be enhanced. In addition to potentially enabling magnetic hysteresis heating, this can result in greater or improved Joule heating of the heating material, and thus greater or improved heating of the body of aerosolizable material 3.

In this example, the heating material is in direct contact with the body of aerosolizable material 3. Thus, when the heating material of the closed circuit is heated by penetration with a varying magnetic field, heat may be transferred directly from the heating material of the closed circuit to the body of aerosolizable material 3.

Referring again to FIG. 1, when the article 1 is in a partially assembled state, the first wrapper 5 is arranged so that the so that the two opposing strips 9*a*, 9*b* of the inner surface 9 extend radially from the body of the aerosolizable material 3. This facilitates joining the two opposing strips 9*a*, 9*b* of the inner surface 9 together.

In some examples, the two opposing strips 9*a*, 9*b* of the inner surface 9 are joined together by welding, for example, by heat welding, laser welding, ultrasonic welding, or pressure welding (sometimes referred to as cold or contact welding).

In other examples, the two opposing strips 9*a*, 9*b* of the inner surface 9 are joined together by means of an electrically conductive adhesive.

It should be appreciated that any suitable technique can be used to join the two opposing strips 9*a*, 9*b* of the inner surface 9 together provided a closed electrical loop is formed by the wrapper 5. Other techniques may include mechanical riveting, and crimping or embossing of the opposing strips 9*a*, 9*b*.

In the event where heat is used to join the two opposing strips 9*a*, 9*b*, or where heat is generated as a result of the joining process, a heat sink may be provided in proximity to one or both of the opposing strips 9*a*, 9*b*. For example, a heat sink (which may be a block of metal) may be pressed against the substrate 11 directly adjacent strip 9*b*. As a result, a portion (or all) of the heat may be directed to the heat sink as opposed to the aerosolizable material 3. Anvil 52 and/or horn 54 shown in FIG. 5 and described below may be considered a heat sink.

Referring back to FIG. 2, after the two opposing strips 9*a*, 9*b* of the inner surface 9 are joined, the ends 5*a*, 5*b* of the wrapper 5 are folded so that the ends 5*a*, 5*b* of the wrapper are folded about the body 3 of aerosolizable material, for example, substantially tangentially to the body 3 of aerosolizable material.

As is illustrated in FIG. 2, in some examples, the article 1 may further comprise a further wrapper 15 that is wrapped around and encircles the first wrapper 5 and the body or aerosolizable material 3.

The further wrapper 15 may be formed from any suitable material. In some examples, the further wrapper 15 comprises a non-electrically conductive material, such as paper or card. The further wrapper 15 may be free of heating material.

In other examples, the further wrapped may additionally or alternatively comprise an electrically conductive material. The further wrapper 15 may, for example, be the same as the first wrapper 5. In some examples, the further wrapper 15 consists entirely, or substantially entirely, of the heating material, and is for example a metallized foil wrapper. In some example, the further wrapper 15 may comprise a closed circuit of the heating material that encircles the body of aerosolizable material 3. The further wrapper 15 may comprise electrically-conductive material, such as a layer of electrically-conductive material that encircles the body of aerosolizable material 3. The heating material of the further wrapper 15 may comprise any one or more of the materials discussed above for the heating material of the first wrapper 5. In some cases, however, when an electrically conductive heating material is comprised in the further wrapper 15, the heating material may absorb some or all of the energy from an inductive element (e.g., element 458 in FIG. 6) which may not be desirable depending on the construction of the article 1, and in particular the thermal transfer efficiency from the wrapper 15 to the aerosolizable material 3.

In yet further examples, the further wrapper 15 may be formed from a thermally insulating material to prevent or reduce heat transfer from the wrapper 5 to the outer surface of the further wrapper 15.

In some examples, the further wrapper 15 helps maintain the folded ends 5*a*, 5*b* of the first wrapper 5 in position.

The further wrapper 15 comprises free ends 15*a*, 15*b* which in the example shown in FIG. 2 are joined by an adhesive strip 17. Such adhering may have the effect of holding both the first wrapper 5 and the further wrapper 15 in position relative to the body of aerosolizable material 3. In particular, the first wrapper 15 may be wrapped so as to hold the folded portion of the wrapper 5 to the outer surface 7 of the wrapper 5. This can increase the mechanical integrity of the article 1, by preventing the folded portion of wrapper 5 from being pulled or caught during use of the article 1. Additionally, the further wrapper 15 may be arranged to provide a more visually pleasing outer surface of the article 1 for the user, by hiding the folded portion of wrapper 5. A benefit of using a further wrapper 15 is that the adhesive strip 17 that adheres the free ends 15*a*, 15*b* of the further wrapper 15 to each other need not comprise heating material; that is, the free ends 15*a*, 15*b* need not be electrically connected to one another. The adhesive strip 17 may comprise one or more of, for example, gum Arabic, natural or synthetic resins, starches, and varnish.

In other examples, the free ends 15*a*, 15*b* of the further wrapper 15 may be welded together using any of the techniques discussed above.

In other examples, the further wrapper 15 may partially wrap and encircle the first wrapper 5 and the body of aerosolizable material 3. For example, and with reference to FIG. 2, the further wrapper 15 may be wrapped such that the free end 15*a* abuts a first part of the folded portion of wrapper 5, while the free end 15*b* abuts a second part of the folded portion of wrapper 5. For example, the further wrapper 15 may be wrapped around the wrapper 5 so as to cover the majority of the outer surface 7 of the wrapper 5 with the exception of the folded portion of wrapper 5. In this way, the further wrapper 15 may be arranged to form a flush outer surface of the article 1 with the folded portion "book-ended" by the free ends of the further wrapper 15. Adhesive may be provided at any suitable location between the further wrapper 15 and the wrapper 5.

The heating material may have a skin depth, which is an exterior zone within which most of an induced electrical current and/or induced reorientation of magnetic dipoles occurs. By providing that the heating material has a relatively small thickness, a greater proportion of the heating material may be heatable by a given varying magnetic field, as compared to heating material having a depth or thickness that is relatively large as compared to the other dimensions of the heating material. Thus, a more efficient use of material is achieved. In turn, costs are reduced.

In some examples, the heating material may not be susceptible to eddy currents being induced therein by penetration with a varying magnetic field. In such embodiments, the heating material may be a magnetic material that is non-electrically-conductive, and thus may be heatable by the magnetic hysteresis process discussed above.

In the example shown in FIGS. 1 to 3, the first wrapper 5 comprises the first layer, of substrate material 11 lined with the second layer of metallized foil 13. In alternative examples, the first wrapper 5 comprises the layer of metallized foil 13 but no first layer of substrate material 11. In these examples, it will be appreciated that the outer surface of the first wrapper 5 is an outer surface of the layer of metallized foil 13.

Figure 4A:
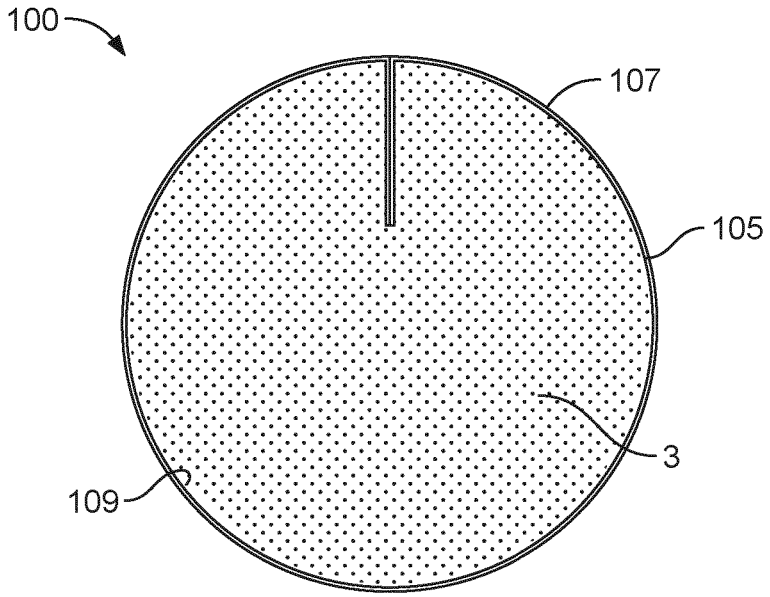
FIG. 4*a* a schematic cross-sectional view of another example of an article when the article is in a fully assembled state.
Figure 4B:
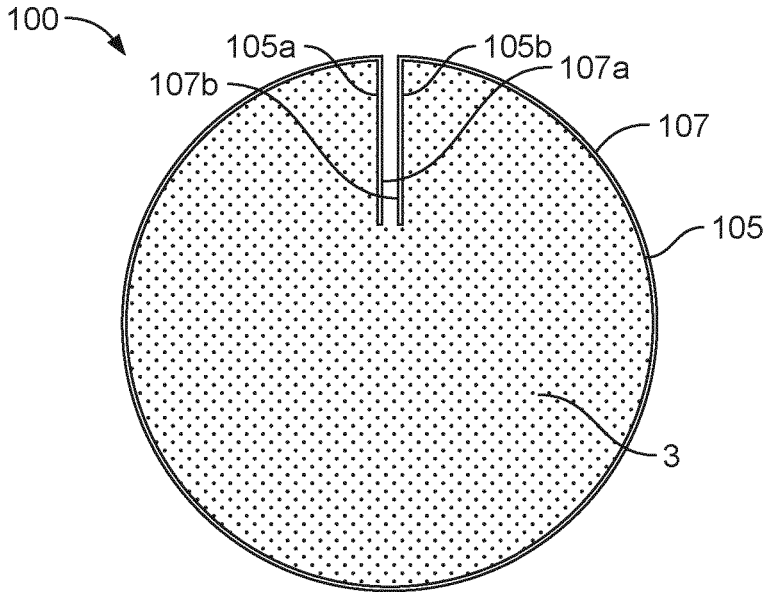
FIG. 4*b* is a schematic cross-sectional view of the another example of an article when the article is in a partly assembled state.

FIGS. 4*a* and 4*b* schematically illustrate a second example of an article 100 for use with an apparatus for heating, but not burning, aerosolizable material. The article 100 is similar to the article 1 described above and like features of the two articles 1, 100 have the same reference numerals.

The article 100 comprises a body of aerosolizable material 3 and a first wrapper 105 around the body of aerosolizable material 3. As in the first example, the body of aerosolizable material 3 is elongate and cylindrical with a substantially circular cross section and the article 100 has proportions approximating those of a traditional combustible cigarette. However, in other examples, the body of aerosolizable material 3 may have a cross section other than circular and/or not be elongate and/or not be cylindrical.

In this example, the first wrapper 105 again comprises heating material that is heatable by penetration with a varying magnetic field. Although not shown in FIGS. 6*a* and 6*b*, similarly to the first wrapper 5 described above, in some examples the first wrapper 105 may comprise a first layer of substrate material lined with a second layer of metallized foil and in other examples may comprise a layer of metallized foil but no substrate layer.

In this example, the first wrapper 105 comprises an outer surface 107 and an inner surface 109, but unlike in the first example described above, in this second example, it is two opposing strips 107*a*, 107*b* of the outer surface 107, rather than the inner surface 109, that are joined along free ends 105*a*, 105*b* of the wrapper 105 in order to form a closed electrical circuit of the heater material. To that end, the outer surface 107 is a surface of the layer of metallized foil.

It should be appreciated that FIG. 4*b* shows the article 100 in a partially assembled state before the two opposing strips 107*a*, 107*b* of the outer surface 107 have been joined along free ends 105*a*, 105*b* of the wrapper 105.

As shown in FIG. 4*a*, when the article 100 is fully assembled, the free ends 105*a*, 105*b* of the wrapper 105 which now join the two opposing strips 107*a*, 107*b* of the outer surface 107 extend substantially radially into the body of aerosolizable material 3.

Figure 5:
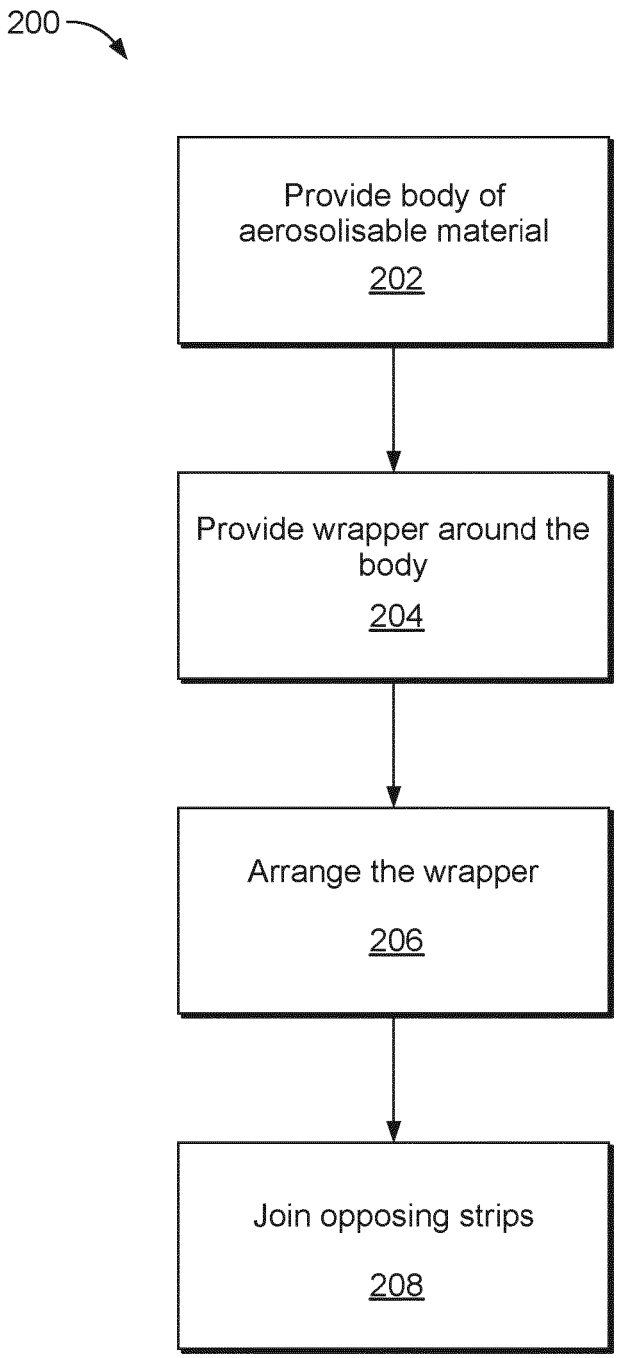
FIG. 5 shows a flow diagram of an example of manufacturing an article for use with an apparatus for heating aerosolizable material.

Referring now to FIG. 5 there is shown a flow diagram of an example of a method of manufacturing an article for use with apparatus for heating aerosolizable material to volatilize at least one component of the aerosolisable material. The method may be used to manufacture the article 1 or the article 100 described above.

A body of aerosolizable material is provided at 202. A wrapper is provided, at 204, around the body of aerosolizable material, the wrapper comprising a heater material that is heatable by penetration with a varying magnetic field and the wrapper comprising an outer surface and an inner surface. The wrapper is arranged, at 206, so that two opposing strips of the outer surface contact each other along ends of the wrapper or, is arranged so that two opposing strips of the inner surface contact each other along ends of the wrapper. The two opposing strips are joined, at 208, so as to form a closed electrical circuit of the heater material.

As already mentioned above, in the case of the article 1, the two opposing strips 9*a*, 9*b* of the inner surface 9 may be joined together by welding, for example, by heat welding, laser welding or ultrasonic welding.

Figure 6:
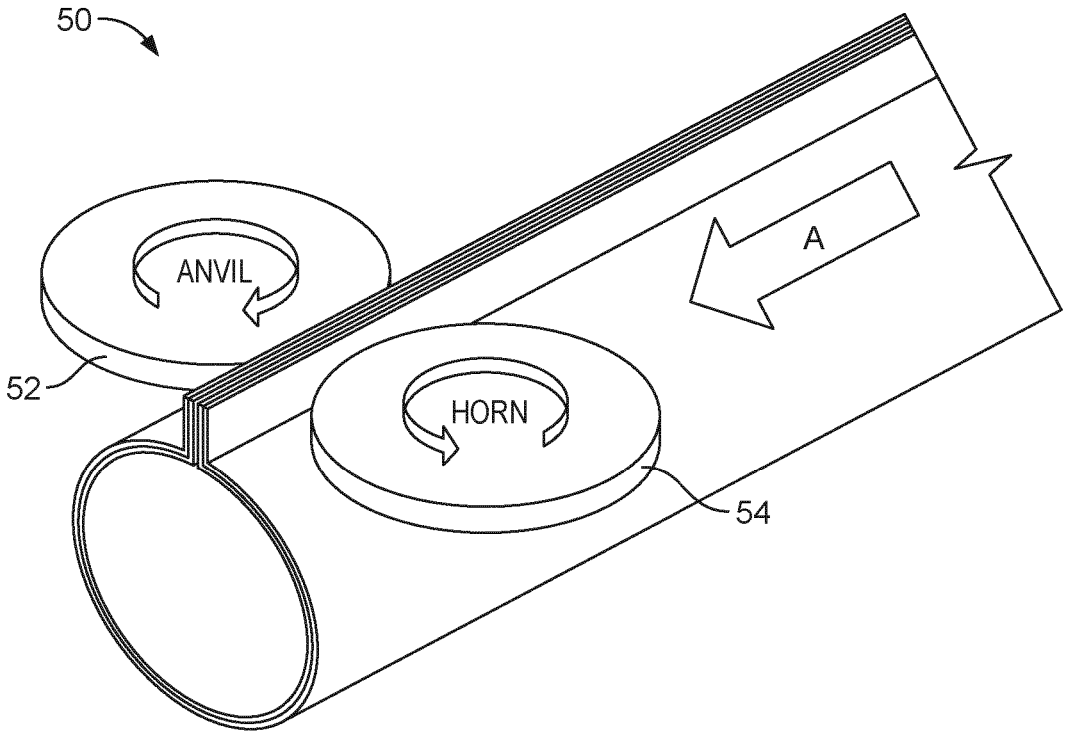
FIG. 6 shows a schematic perspective view showing apparatus for use in making the article of FIG. 1.

As is schematically illustrated in FIG. 6, in some examples of manufacturing the article 1, the first wrapper 5 is formed by a guide (not shown) into a tube shape around the body of aerosolizable material 3 with the two opposing strips 9*a*, 9*b* of the inner surface 9 facing each other and then the first wrapper 5 is continually run (as represented by arrow A) through a welding device 50 which welds the two opposing strips 9*a*, 9*b* of the inner surface 9 together.

In one example, the welding device 50 is a continuous ultrasonic welding device comprising an anvil 52 and a horn 54 which rotate in opposite senses as indicated by the curved arrows. The ends 5*a*, 5*b* of the wrapper 5, which extend radially away from the body if aerosolizable material, travel between the anvil 52 and the horn 54. The horn 54 presses the ends 5*a*, 5*b* against the anvil 52 and delivers ultrasonic vibrations which heat up the two opposing strips 9*a*, 9*b* of the inner surface 9 to weld them together.

In some examples, the article 1 may be manufactured using a modified cigarette making machine with the welding device 50 located after the section that wraps tobacco with cigarette paper.

The machine will comprise cutters to cut the article 1 to the correct length.

FIG. 7 illustrates schematically components of an apparatus 200 and steps that may be used, for example, to manufacture the article 100.

The apparatus comprises a mold 202 comprising a first part 202*a* and second part 202*b* that are joined by a hinge (H). The first part 202*a* and the second part 202*b* each comprises a respective elongate track 204, 206 that are both substantially semi-circular in cross sections and run parallel and side by side when the mold 202 is open as shown in FIG. 7*a*.

Figure 7A:
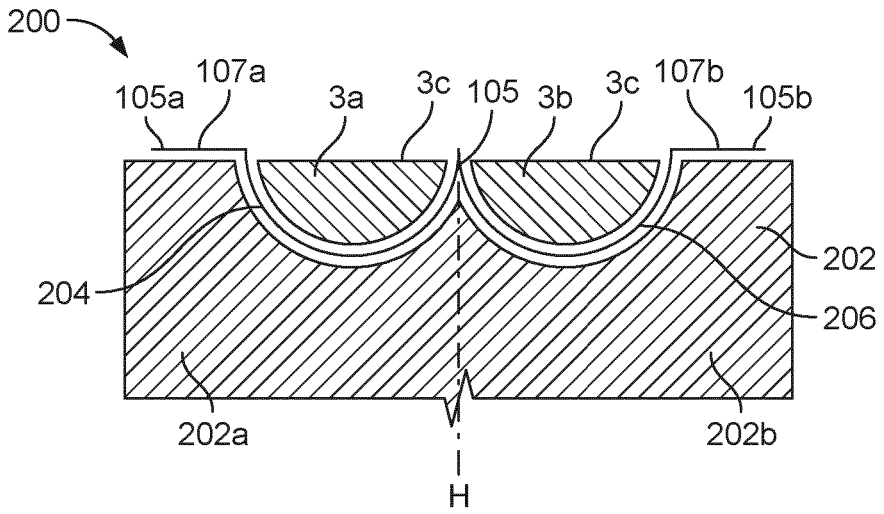
FIGS. 7*a* to 7*c* shows a schematic end on view of an apparatus and steps for making the another article of FIGS. 4*a* and 4*b*.

As shown in FIG. 7*a*, in a first step the first wrapper 105 is placed on the open mold 202 so that the first wrapper 105 lines the elongate tracks 204, 206 (the first wrapper 105, may for example, be pressed in the elongate tracks 204, 206 by a correspondingly shaped press not shown).

Next, a first half 3*a* of aerosolizable material 3 is placed in the first elongate track 204 and a second half 3*b* of aerosolizable material is placed in the second elongate track 206 on top of the inner surface of the first wrapper 105. The first 3*a* and second 3*b* halves of the aerosolizable material are also semi-circular in cross section and have exposed planar sections 3*c* facing away from the open mold 202.

In the configuration shown in FIG. 7*a*, the free ends 105*a*, 105*b* of the first wrapper 105 are positioned outside of the elongate tracks 204, 206 with the strips 107*a*, 107*b* of the outer surface 107 facing downwards towards the open mold 202.

Figure 7B:
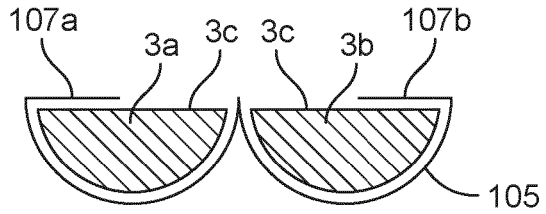

Next, each of the free ends 105*a*, 105*b* of the first wrapper 105 are folded over into the position shown in FIG. 7*b* (which for simplicity does not show the mold 202) in which each of the free ends 105*a*, 105*b* partly overlies a planar section 3*c* of a respective one of the first 3*a* and second 3*b* halves of the aerosolizable material such that the strips 107*a*, 107*b* of the outer surface 107 now face upwards away from the open mold 202.

Figure 7C:
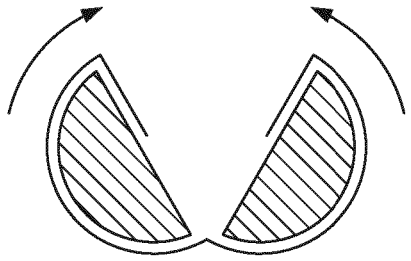

Next, as is illustrated in FIG. 7*c*, the tobacco mold 202 (which again for clarity isn't shown in FIG. 7*c*) is closed (as illustrated by the arrows) by bringing the two hinged parts 202*a* and 202*b* together to press the planar sections 3*c* of the first 3*a* and second 3*b* halves of the aerosolizable material together to form a unitary body of aerosolizable material in which the two opposing strips 107*a*, 107*b* of the outer surface 107 are joined together and extend substantially radially into the body of aerosolizable material.

Figure 8:
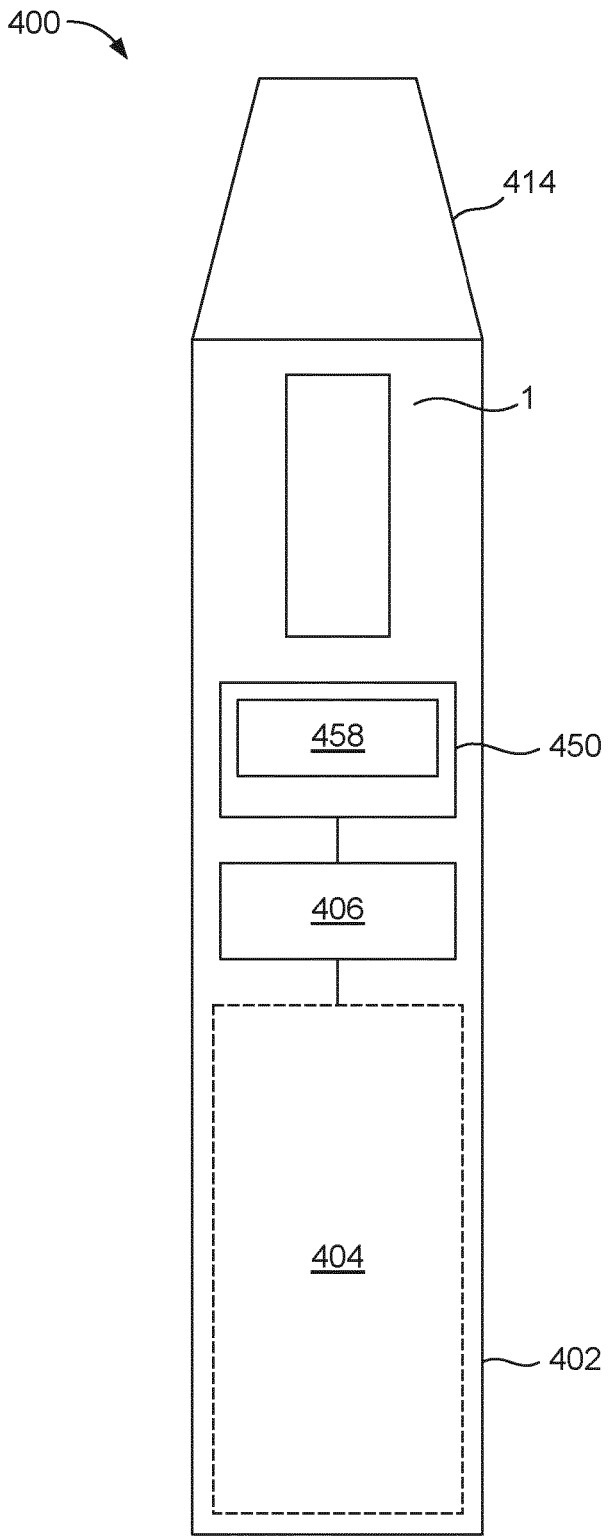
FIG. 8 shows a schematic view of an apparatus for heating aerosolizable material.

FIG. 8 illustrates schematically an aerosol generating device 400, according to an example. The aerosol generating device 400 comprises a housing 402 that contains a DC power source 404, in this example a battery 404, a circuit 450 comprising an inductive element 458 and an article 1 (or 100) as described above.

In the example of FIG. 8, the DC power source 404 is electrically connected to the circuit 450 and is arranged to provide DC electrical power to the circuit 450. The device 400 also comprises control circuitry 406 and in this example the circuit 450 is connected to the battery 404 via the control circuitry 406.

The control circuitry 406 may comprise means for switching the device 400 on and off, for example in response to a user input. The control circuitry 406 may for example comprise a puff detector (not shown), as is known per se, and/or may take user input via at least one button or touch control (not shown). The control circuitry 406 may comprise means for monitoring the temperature of components of the device 400 or components of the article 1 inserted in the device. The circuit 450 comprises the inductive element 458 as well as other components.

The inductive element 458 may be, for example, for example a coil, which may for example be planar, which may for example be formed from copper. The circuitry 450 is arranged to convert an input DC current from the DC power source 404 into a varying, for example alternating, current through the inductive element 458. The circuitry 450 is arranged to drive the varying current through the inductive element 458.

The heating material of the article 1 is arranged relative to the inductive element 458 for inductive energy transfer from the inductive element 458 to the heating material. In use, the inductive element 458, having varying current driven therethrough, causes the heating material to heat up by Joule heating and/or by magnetic hysteresis heating, as described above which in turn causes heating of the body of aerosolizable material 3 to generate an aerosol.

The aerosol generating device 400 may be hand-held and is arranged to heat the body of aerosolizable material 3 to generate aerosol for inhalation by a user.

Returning again to FIG. 8, the aerosol generating device 400 may comprise a mouthpiece 414 to allow aerosol generated in use to exit the device 400. In other examples, the article 1 itself may extend outside of the generating device 400 and be provided with a mouthpiece through which a user can inhale the aerosol.

The mouthpiece 414, when provided, may comprise or be impregnated with a flavorant. The flavorant may be arranged so as to be picked up by heated vapor as the vapor passes through the mouthpiece 414 in use.

In use, a user may activate, for example via a button (not shown) or a puff detector (not shown), the circuitry 406 to cause alternating current to be driven through the inductive element 408, thereby inductively heating the body of aerosolizable material in the article 1 to generate an aerosol. The aerosol is generated into air drawn into the device 400 from an air inlet (not shown), and is thereby carried to the mouthpiece 414, where the aerosol exits the device 400 for inhalation by a user.

The circuit 450 comprising the inductive element 458 may be arranged to heat the body of aerosolizable material in the article 1 to a range of temperatures to volatilize at least one component of the aerosolizable material without combusting the aerosolizable material. For example, the temperature range may be about 50° C. to about 350° C., such as between about 50° C. and about 300° C., between about 70° C. and about 280° C., between about 100° C. and about 250° C., between about 120° C. and about 240° C., between about 140° C. and about 230° C., or between about 150° C. and about 220° C. In some examples, the temperature range is between about 170° C. and about 220° C. In some examples, the temperature range may be other than this range, and the upper limit of the temperature range may be greater than 300° C.

The article 1 may be removably inserted by a user into a heating chamber in the apparatus 400 and may be replaced by a fresh article after use when the body of aerosolizable material 3 is exhausted.

In order to address various issues and advance the art, the entirety of this disclosure shows by way of illustration and example various embodiments in which the claimed invention may be practiced and which provide for superior articles for use with apparatus for heating smokable material to volatilize at least one component of the smokable material, superior methods of manufacturing such articles, and superior systems comprising such articles and such apparatus. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An article for use with an apparatus for heating aerosolizable material to volatilize at least one component of the aerosolizable material, the article comprising:

a body of aerosolizable material; and a first wrapper around the body of aerosolizable material, wherein the first wrapper comprises heater material that is heatable by penetration with a varying magnetic field, the first wrapper comprising an outer surface and an inner surface and wherein the first wrapper is arranged so that two opposing strips of the outer surface are joined along ends of the first wrapper so as to form a closed electrical circuit of the heater material, and the two opposing strips of the outer surface are joined along ends of the first wrapper extend into the body of aerosolizable material.

2. The article according to claim 1, wherein the first wrapper comprises a layer of metallized foil which is the heater material.

3. The article according to claim 2, wherein the first wrapper comprises a layer of substrate material lined with the layer of metallized foil.

4. The article according to claim 2, wherein the first wrapper is folded so that two opposing strips of the outer surface contact each other at joined ends of the first wrapper and the outer surface is an outer surface of the layer of metallized foil.

5. The article according to claim 1, further comprising a further wrapper wrapped around the first wrapper.

6. The article according to claim 5, wherein ends of the further wrapper are joined together by an adhesive or by a weld.

7. The article according to claim 5, wherein the further wrapper comprises paper.

8. The article according to claim 1, wherein the article is elongate.

9. The article according to claim 1, wherein the article is substantially cylindrical.

10. The article according to claim 1, wherein the aerosolizable material comprises at least one of tobacco or one or more humectants.

11. A system comprising:

an apparatus for heating aerosolizable material to volatilize at least one component of the aerosolizable material; and the article according to claim 1.

12. A method of manufacturing an article for use with an apparatus for heating aerosolizable material to volatilize at least one component of the aerosolizable material, the method comprising:

providing a body of aerosolizable material;

providing a first wrapper around the body of aerosolizable material, wherein the first wrapper comprises heater material that is heatable by penetration with a varying magnetic field and the first wrapper comprises an outer surface and an inner surface;

arranging the first wrapper so that two opposing strips of the outer surface contact each other along ends of the first wrapper; and joining the two opposing strips so as to form a closed electrical circuit of the heater material, and the two opposing strips of the outer surface are joined along ends of the first wrapper extend into the body of aerosolizable material.

* * * * *